US006314702B1

(12) United States Patent
Huang

(10) Patent No.: US 6,314,702 B1
(45) Date of Patent: Nov. 13, 2001

(54) ASSEMBLED FRAME STRUCTURE

(76) Inventor: Chien-Teh Huang, No. 105, Sec. 4, San Ho Rd., San Chon City, Taipei Hsien (TW)

( * ) Notice: Subject to any disclaimer, the term of this patent is extended or adjusted under 35 U.S.C. 154(b) by 0 days.

(21) Appl. No.: 09/565,464

(22) Filed: May 5, 2000

(51) Int. Cl.[7] ..... E04C 2/38

(52) U.S. Cl. ..... 52/656.1; 52/656.9; 52/655.1; 52/281; 52/285.2; 52/282.3; 52/79.9

(58) Field of Search ..... 52/506.06, 580, 52/585.1, 663, 655.1, 281, 282.2, 476, 633, 282.3, 282.4, 656.9, 656.1, 762, 764, 79.9, 79.12, 79.13, 81.3

(56) References Cited

U.S. PATENT DOCUMENTS 5,560,151 * 10/1996 Roberts ..... 52/81.1
6,047,509 * 4/2000 Savoie ..... 52/281

* cited by examiner

*Primary Examiner*—Beth A. Stephan
*Assistant Examiner*—Jennifer I. Thissell
(74) *Attorney, Agent, or Firm*—Rosenberg, Klein & Lee

(57) ABSTRACT

An assembled frame structure is provided. The structure includes a plurality of frame units, a plurality of connecting seats, and at least one screw element. The frame unit forms a hollow structure. The inner edge thereof describes a rectangular shape, while the outer edge thereof describes an approximate rectangular shape. The approximate rectangular shape has four chamfered corners. A spacer is disposed between the inner edge and the outer edge. A spacer describes a shape identical to that of the outer edge and has four connecting corners which extend in parallel to and opposite the chamfered corners. The spacer is offset from the inner edge as well as from the outer edge. Each of the connecting corners has formed therein a screw hole. The chamfered corners of adjacent frame units are disposed such that their screw holes align with the screw hole of a connecting seat positioned therebetween, so that the screw unit may be engaged with the holes in locked manner. An assembled frame structure having modular frames is thus formed.

8 Claims, 7 Drawing Sheets

ASSEMBLED FRAME STRUCTURE

FIELD OF THE INVENTION

The present invention relates to an assembled frame structure, and more specifically to an assembled frame structure having modular frame units, which is earthquake-tolerant and can be assembled with less labor, time, and materials.

BACKGROUND OF THE INVENTION

A prior art assembled frame structure is illustrated in Taiwan Patent No. 345230, entitled "A Ceiling Frame Structure." However, there are many defects in this design, for example, if one frame unit is impacted, since one supporting frame supports the whole structure, the other frame units will also be impacted and thus deform. Therefore, a large impact surface is formed. Moreover, use of the frame material is limited to a set flexibility. Furthermore, the structure is weak so it cannot be supplemented with a track for supportively moving heavy articles. Further, the assembly and installation of the structure is complex, requiring much labor and time.

Therefore, there is a need for a novel assembled frame structure having modular frame units, which is earthquake-tolerant and can be assembled with less labor and time, and requires less materials.

SUMMARY OF THE INVENTION

Accordingly, the object of the present invention is to provide an assembled frame structure with modular frames. At least one screw element, a plurality of connecting seats, and a plurality of frame units are assembled. If an earthquake were to occur, and some of the frame units are impacted, the impact force will be dispersed to the other frame units. The material of the frame units can be of selectable flexibility. The present invention yields a strong structure, such that a guide track can be added to the frame unit with a movable hook serving to support and move a heavy article. Furthermore, the present invention can be easily assembled with less labor and in less time.

The various objects and advantages of the present invention will be more readily understood from the following detailed description when read in conjunction with the appended drawings.

DETAILED DESCRIPTION OF THE PREFERRED EMBODIMENTS

Figure 1:
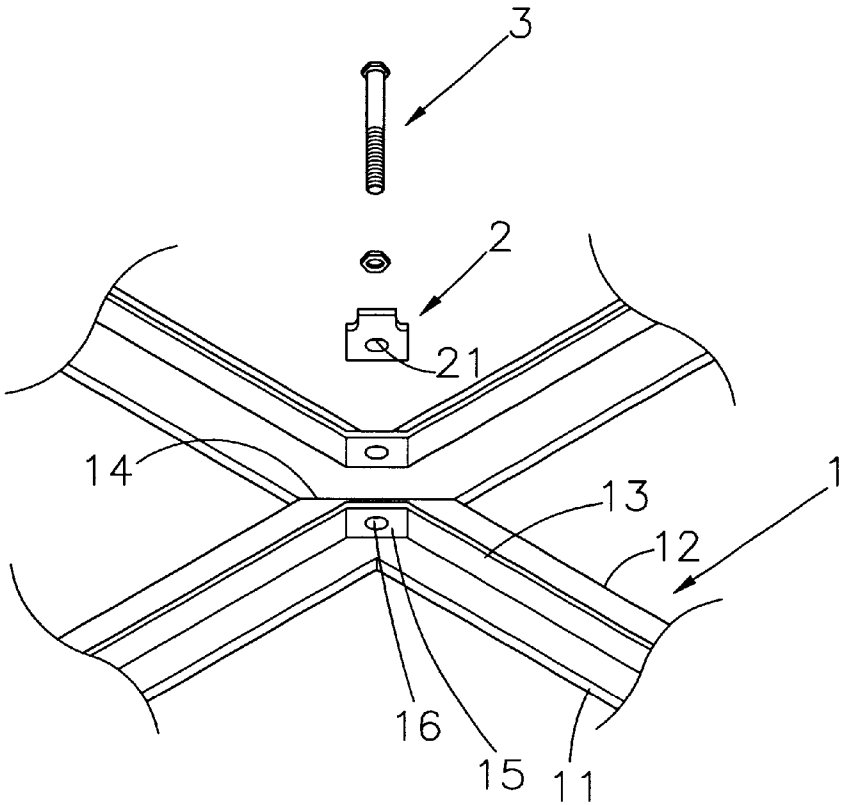
FIG. 1 is an exploded perspective view showing the assembled frame structure with modular frames of the present invention.
Figure 2:
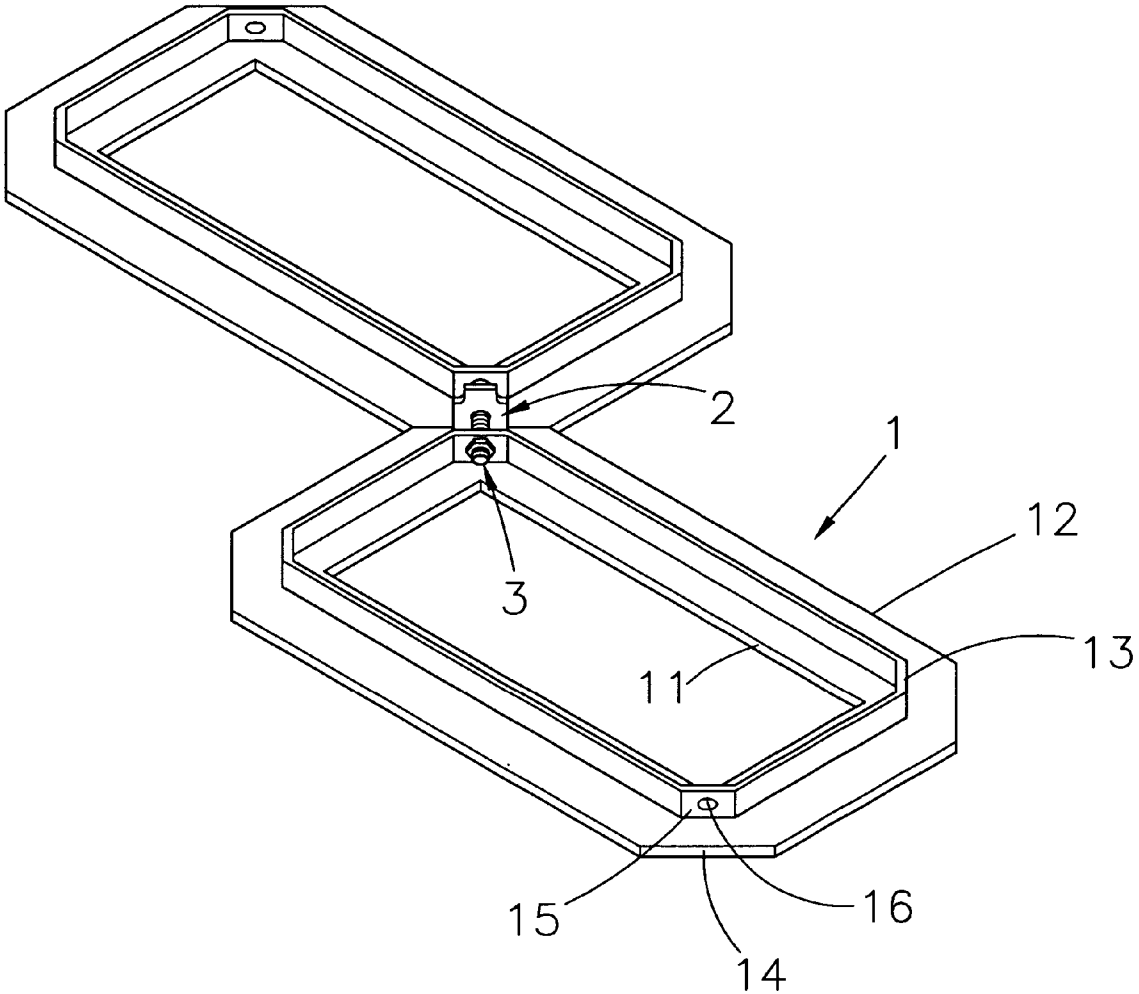
FIG. 2 is an assembled perspective view of the present invention showing two frame units.

With reference to FIGS. 1 and 2, the assembled frame structure according to the present invention is illustrated therein. The assembled frame structure of the present invention includes a plurality of frame units 1, a plurality of connecting seats 2, and at least one screw element 3. The frame unit 1 is formed with a hollow configuration. The inner edge 11 thereof describes a rectangular shape, while the outer edge 12 thereof describes an approximate rectangular shape. The approximate rectangular shape includes four chamfered corners 14. A spacer 13 is disposed between the inner edge 11 and the outer edge 12. The spacer 13 describes a shape identical to that of the outer edge 12 and has four connecting corners 15 which extend in parallel to and opposite the chamfered corners 14. Proper spacing is maintained between the spacer 13 and the inner edge 11, and between the spacer 13 and the outer edge 12. Each of the connecting corners 15 has formed therein a screw hole 16 at a proper position.

A plurality of frame units 1 are disposed such that the chamfered corners 14 of adjacent ones are aligned with each other. The screw holes 21 of the connecting seats 2 positioned between opposing connecting corners 15 are aligned with the screw holes 16 of those connecting corners 15, such that the screw unit 3 may be securely engaged with the holes. An assembled frame structure having modular frames is thus formed.

Figure 3:
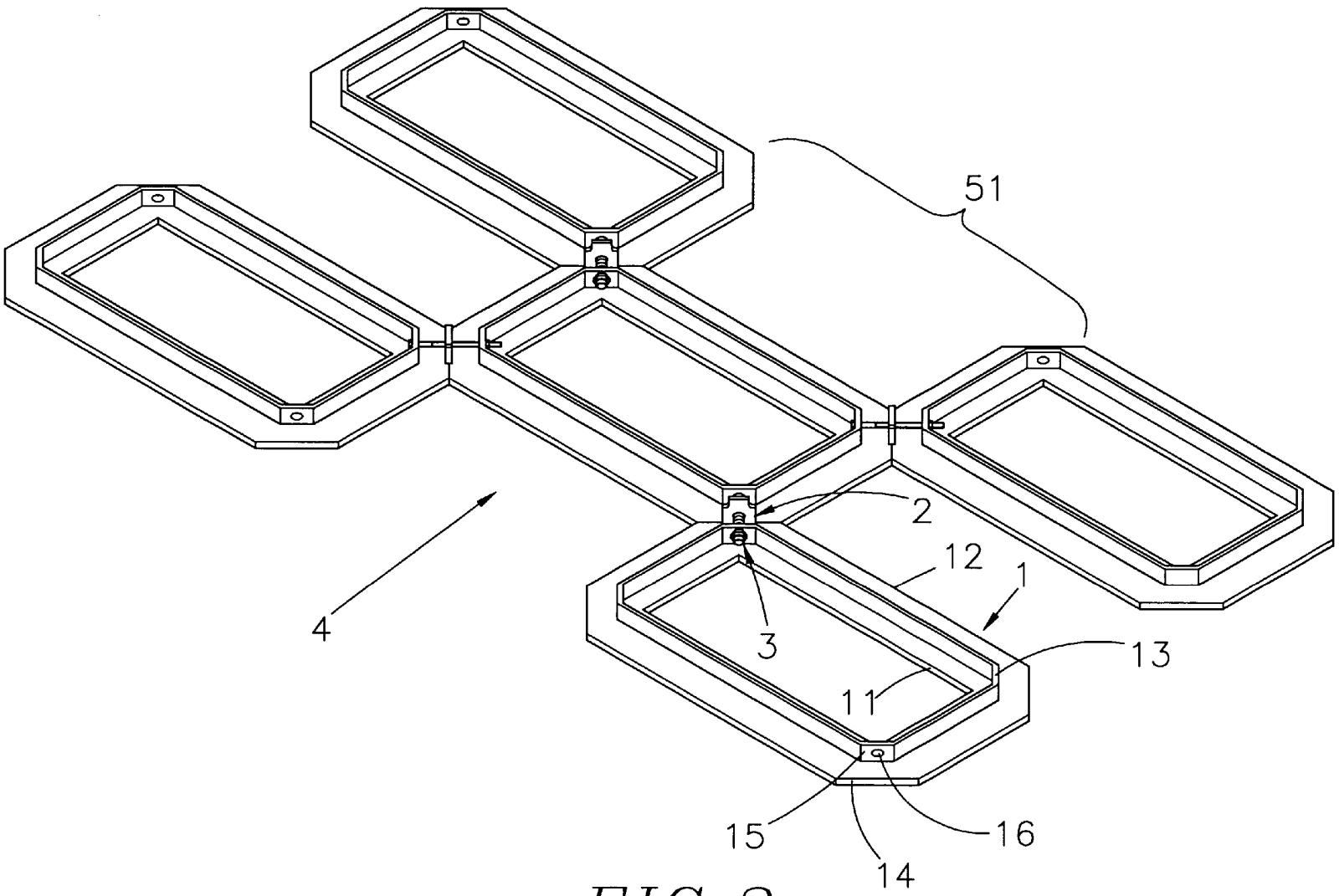
FIG. 3 is a partial assembled perspective view showing a first embodiment of the present invention, as used as a ceiling.
Figure 7:
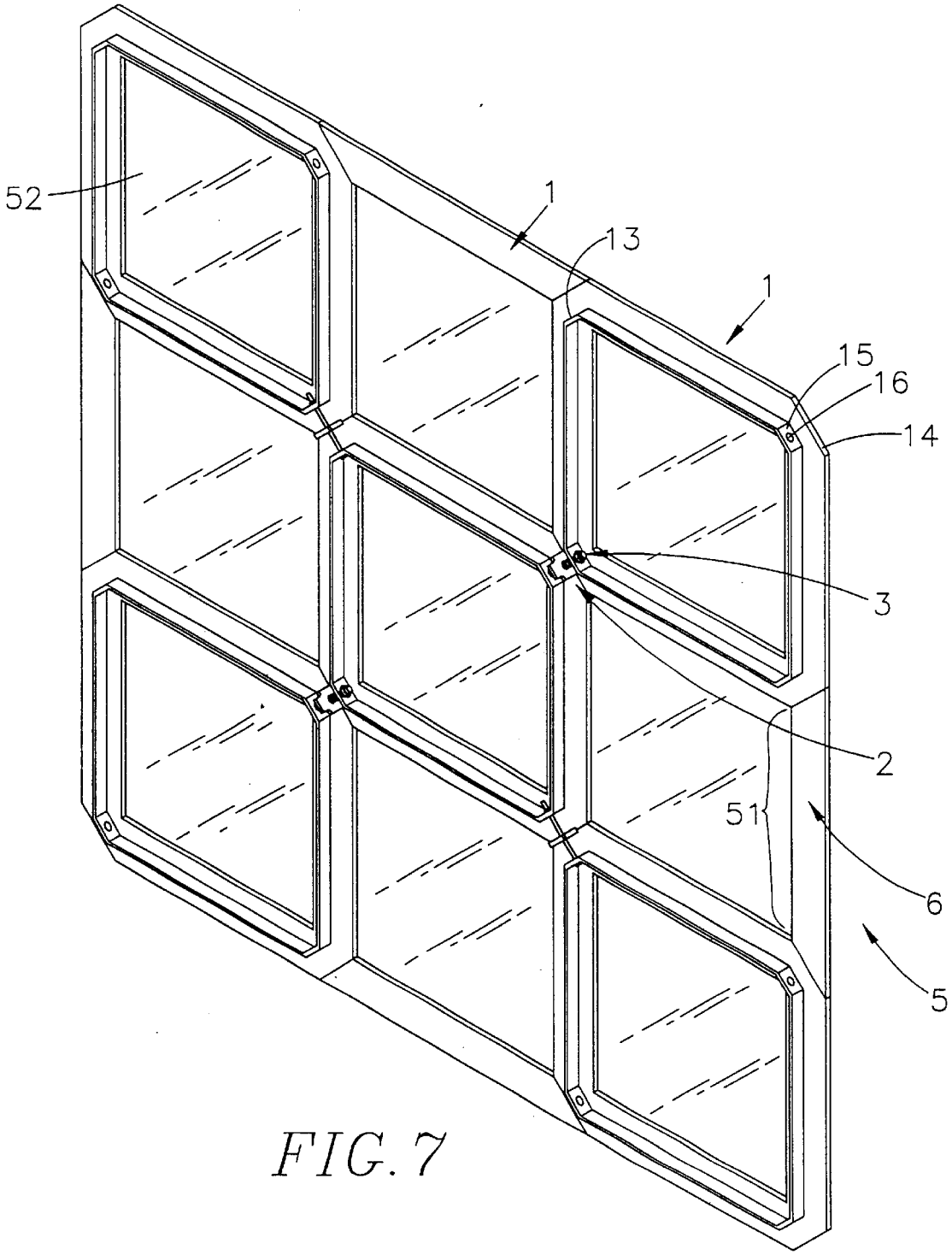
FIG. 7 is a partial assembled perspective view showing a fourth embodiment of the present invention as used as a glass screen.

As shown in FIG. 3, a perspective view of the assembled structure of the present invention is shown as illustratively used in a ceiling 4. A hanging rod (not shown) may be firmly installed at the top of each connecting seat 2, and a panel (not shown) may be firmly secured inside each frame unit 1. After the structure is assembled, an extending plate 6 (see FIGS. 4 and 7) is added to each notch 51 defined between adjacent frame units 1.

Figure 4:
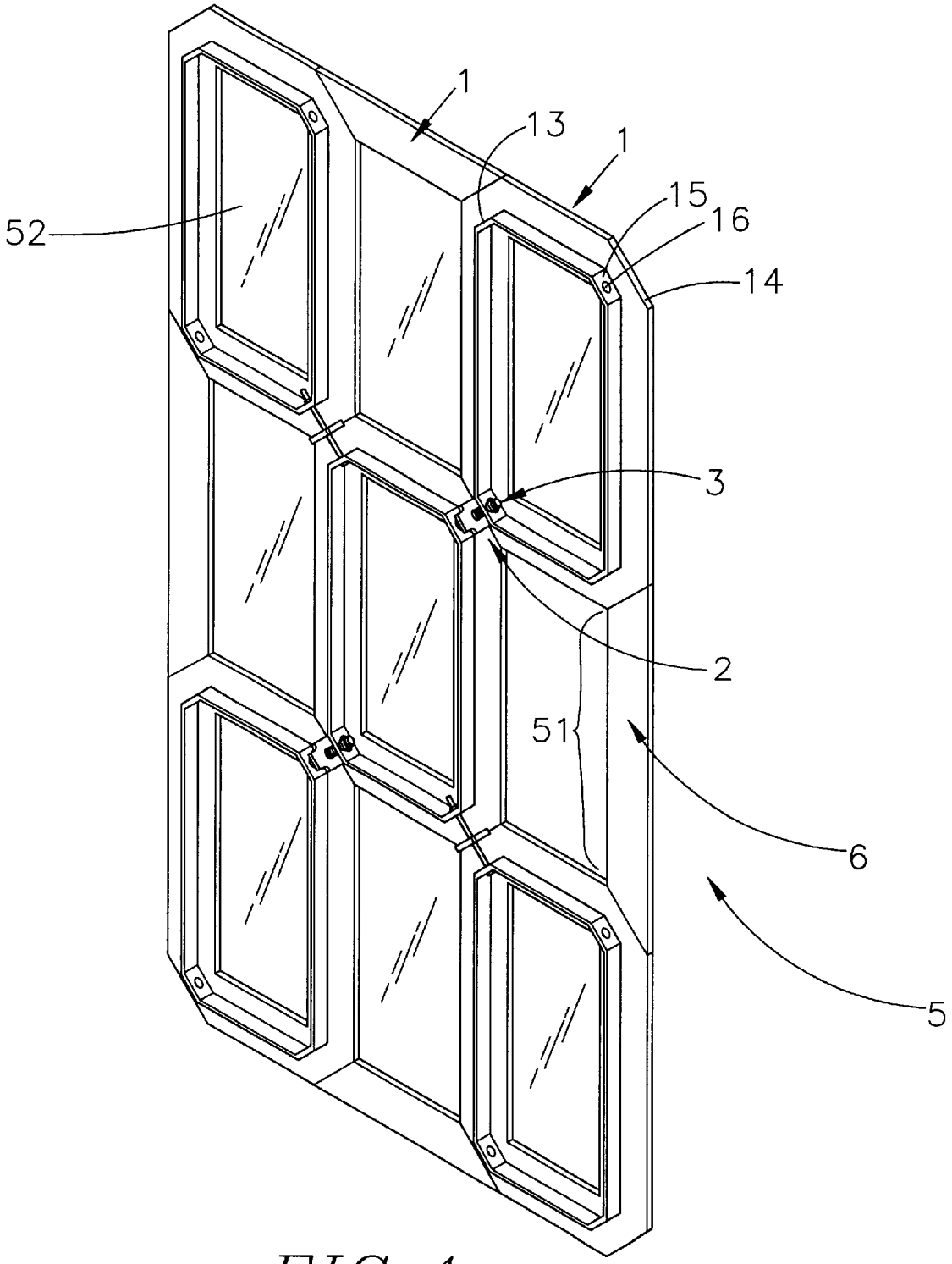
FIG. 4 is a partial assembled perspective assembled view showing a second embodiment of the present invention as used as a glass screen.

As shown in FIG. 4, a perspective view of another embodiment of the present invention wherein the structure serves as a glass screen 5 is illustrated. In order that the structure in this embodiment may be used as a glass screen, an extending plate 6 may be added to each notch 51 after the frame units 1 are assembled together, and a glass panel may be installed within each frame.

Figure 5:
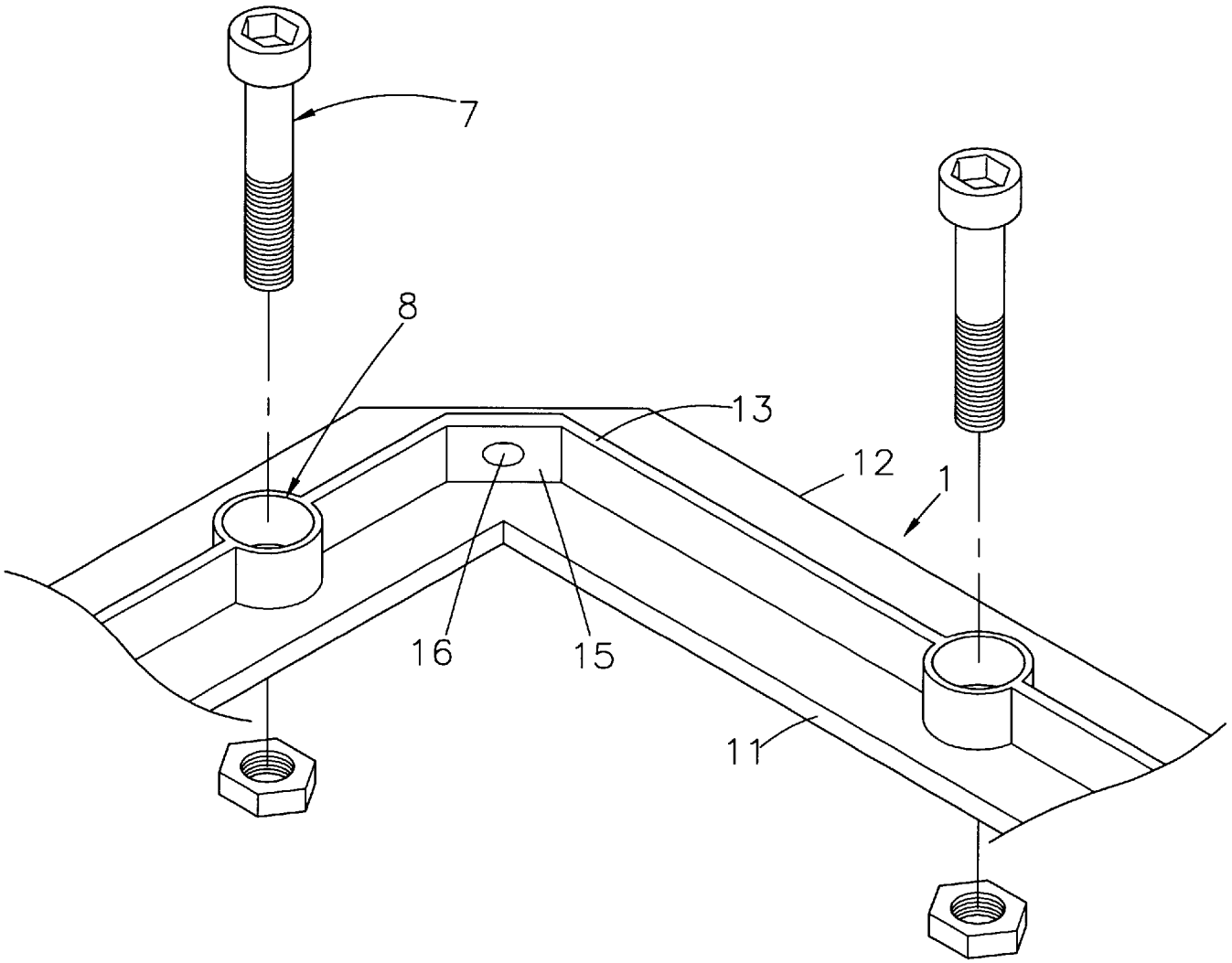
FIG. 5 is a partial assembled perspective view showing a third embodiment wherein screw holes are formed in the spacer of the present invention.
Figure 6:
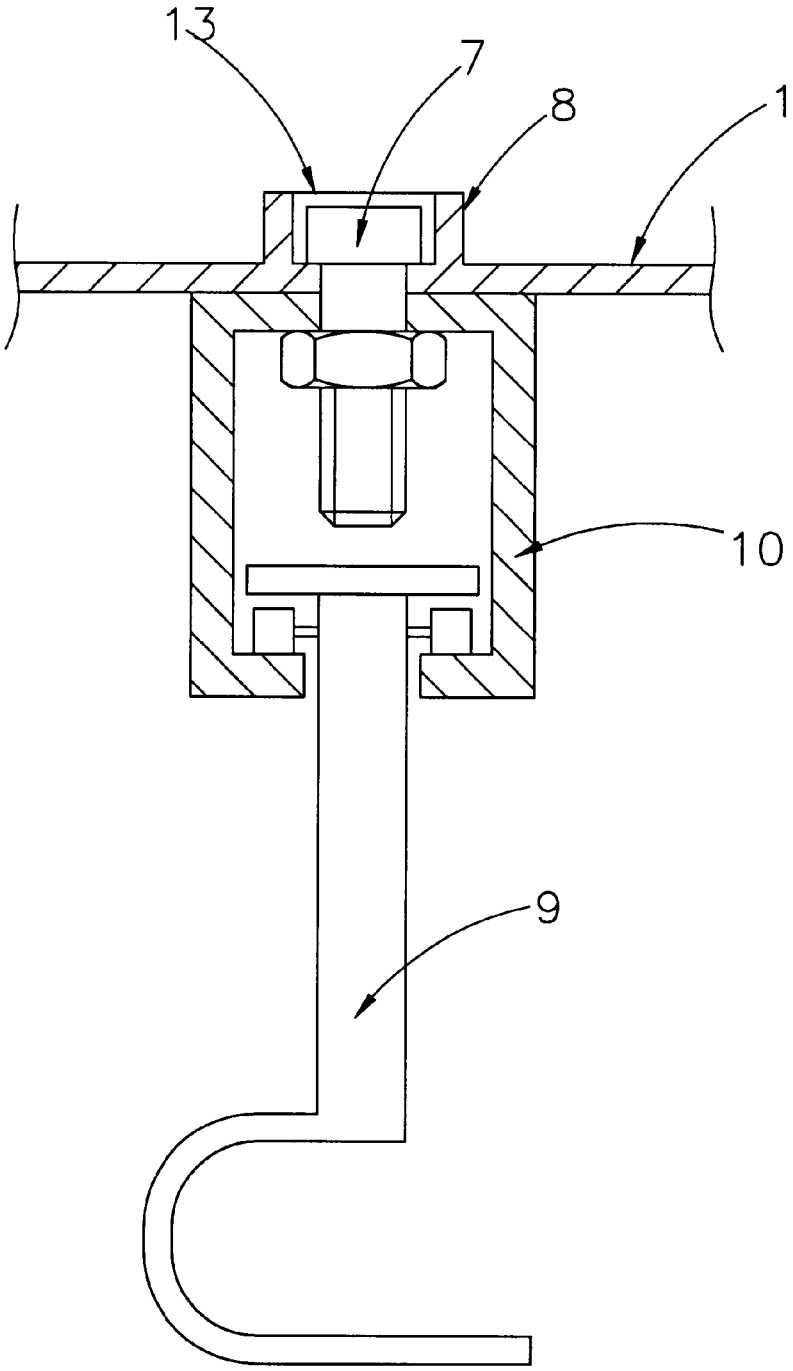
FIG. 6 is a lateral cross sectional view showing a guide track and a movable hook firmly secured by a screw element engaging a screw hole formed in the spacer of the present invention.

As shown in FIGS. 5 and 6, an exploded perspective view shows yet another embodiment of the present invention, wherein screw holes are formed on the spacer 13. The lateral cross sectional view of FIG. 6 illustratively shows a guide track 10 and a movable hook 9 firmly secured by a screw element 7 engaging a screw hole 8 formed in the spacer 13. In this embodiment, the movable hook 9 serves to support a hanging heavy article (not shown) in such manner that the heavy article (not shown) may move along a path (not shown) defined by the guide track.

The present invention has the following advantages:

1. An assembled frame structure with modular frames is provided, wherein at least one screw element, a plurality of connecting seats, and a plurality of frame units are assembled.

2. Even if some frame units are impacted during an earthquake, for instance, the impact force is dispersed to the other frame units.

3. The material of the frame units can be made of selectable flexibility.

4. The present invention yields a sufficiently strong structure that a guide track can be added to the frame unit to support a movable hook that holds and moves a heavy article.

5. The resulting structure can be easily assembled with less labor and in less time than with prior art structures.

Although the present invention has been described with reference to the preferred embodiments, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An assembled frame structure comprising:

a plurality of frame units each having a rectangular shape with a hollow space therein and at four corners of each frame unit being formed respective connecting corners;

a plurality of connecting seats each being installed at the corresponding connecting corner of two frame units; and at least one screw unit each being installed between the connecting seat and connecting corner;

whereby an assembled frame structure is formed.

2. The assembled frame structure as claimed in claim 1, wherein the inner edges of each frame unit are each formed with a rectangular shape, and the outer edges of each frame unit are formed with an approximate rectangular shape, the four corners of the rectangular shape are formed with identical chamfered corners, and an upward spacer is formed between at least one inner edge and at least one outer edge; and at least one screw hole is formed in the connecting corner.

3. The assembled frame structure as claimed in claim 1, wherein the space has a shape identical to that of the outer edge.

4. The assembled frame structure as claimed in claim 1, wherein each connecting corner extends in parallel with at least one chamfered corner.

5. The assembled frame structure as claimed in claim 2, wherein a proper space is formed between the spacer and the inner edge and between the spacer and the outer edge.

6. The assembled frame structure as claimed in claim 1, wherein a panel is installed at an interior of each frame unit.

7. The assembled frame structure as claimed in claim 1, further comprising at least one extending plate engaging a notch defined between a pair of frame units.

8. The assembled frame structure as claimed in claim 1, wherein a plurality of screw holes are installed on the spacer, and a screw element is inserted into the hole for being firmly secured with a guide track and a movable hanging hook for hanging a heavy article, and the heavy article is movable along the guide track.

* * * * *